US009868611B2

(12) United States Patent
Klaczynski

(10) Patent No.: US 9,868,611 B2
(45) Date of Patent: Jan. 16, 2018

(54) YARN TRAVERSING DEVICE FOR A SPOOLING DEVICE OF A TEXTILE MACHINE PRODUCING CROSS-WOUND BOBBINS

(71) Applicant: Saurer Germany GmbH & Co. KG, Remscheid (DE)

(72) Inventor: Elisabeth Klaczynski, Erkelenz (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 0 days.

(21) Appl. No.: 15/422,839

(22) Filed: Feb. 2, 2017

(65) Prior Publication Data

US 2017/0253457 A1 Sep. 7, 2017

(30) Foreign Application Priority Data

Mar. 5, 2016 (DE) ..... 10 2016 002 762

(51) Int. Cl.
*B65H 54/28* (2006.01)
*B65H 54/06* (2006.01)

(52) U.S. Cl.
CPC ..... *B65H 54/2821* (2013.01); *B65H 54/06* (2013.01)

(58) Field of Classification Search
CPC . B65H 54/2821; B65H 54/2824; B65H 54/06
USPC ..... 242/481.3–481.6
See application file for complete search history.

(56) References Cited

U.S. PATENT DOCUMENTS 3,565,359 A * 2/1971 Goodhue ..... B65H 54/2824 242/481.6
4,767,072 A * 8/1988 Kamp ..... B65H 54/2824 242/481.6
5,076,509 A * 12/1991 Kudrus ..... B65H 54/2824 242/481.6
2007/0241225 A1* 10/2007 Preutenborbeck . B65H 54/2821 242/476.4

FOREIGN PATENT DOCUMENTS

CH 510 580 A 7/1971
CN 203 474 084 U 3/2014
DE 37 34 478 A1 4/1989
(Continued)

OTHER PUBLICATIONS

European Search Report for corresponding EP Patent Application No. 17152416.8, dated Jul. 3, 2017.

*Primary Examiner* — William E Dondero
(74) *Attorney, Agent, or Firm* — Nelson Mullins Riley & Scarborough LLP

(57) ABSTRACT

A yarn traversing device (11) for a spooling device (4) of a textile machine producing cross-wound bobbins (1) comprises a yarn guide (25), which is connected by an endless tensioning means designed as a toothed belt (30) to a single drive (34), wherein the toothed belt (30) rotates in a largely closed housing (23) of the yarn traversing device (11) and is guided by guide wheels (31 or 32) arranged laterally next to a traversing area (B) and a drive wheel (41) connected to the electric motor single drive (34). The guide wheels (31 or 32) each have a smooth running surface (33), which is largely resistant to dirt, over which the toothed belt (30) runs with its toothing (38).

5 Claims, 4 Drawing Sheets

(56) References Cited

FOREIGN PATENT DOCUMENTS

| | | | |
|---|---|---|---|
| DE | 38 01 980 | A1 | 7/1989 |
| DE | 195 36 761 | A1 | 4/1997 |
| DE | 103 00 106 | A1 | 8/2003 |
| DE | 10 2004 003 173 | A1 | 8/2005 |
| DE | 20 2005 008691 | U1 | 8/2005 |
| DE | 10 2011 114025 | A1 | 3/2013 |
| EP | 0 950 631 | A1 | 10/1999 |

* cited by examiner

YARN TRAVERSING DEVICE FOR A SPOOLING DEVICE OF A TEXTILE MACHINE PRODUCING CROSS-WOUND BOBBINS

CROSS-REFERENCE TO RELATED APPLICATIONS

This application claims priority from German National Patent Application No. DE 10 2016 002 762.2, filed Mar. 5, 2016, entitled "YARN TRAVERSING DEVICE FOR A SPOOLING DEVICE OF A TEXTILE MACHINE PRODUCING CROSS-WOUND BOBBINS", the entire contents of which are incorporated herein by reference.

FIELD OF THE INVENTION

The invention relates to a yarn traversing device for a spooling device of a textile machine producing cross-wound bobbins. More particularly, the invention relates to such a yarn traversing device comprising a yarn guide which is connected via an endless tensioning means in the form of a toothed belt to a single drive, wherein the toothed belt rotates in a largely closed housing of the yarn traversing device and is guided over guide wheels arranged laterally next to the traversing area and a drive wheel connected to an electric motor single drive.

BACKGROUND OF THE INVENTION

For the production of a textile cross-wound bobbin it is well known on the one hand that is necessary for the relevant textile bobbin to be set into rotation and on the other hand that the yarn running onto the bobbin needs to be traversed during the winding process relatively rapidly along the bobbin axis. The textile bobbins formed in this way then have a so-called cross winding and are characterized not only by having a relatively stable bobbin body but also by exhibiting good reeling behaviour.

In connection with the production of such cross-wound bobbins various different yarn traversing devices have been known for a long time, which are described in a relatively large amount of detail in numerous patent applications.

For example in cross-wound bobbin machines which operate at relatively high winding speeds, it is common to use so-called yarn guiding drums as yarn traversing devices at the workstations. Such yarn guiding drums each have an endless groove for traversing the on-running yarn and at the same time drive the textile bobbins in a frictional manner.

However, depending on the system these types of tried and tested yarn guiding drums only enable the production of cross-wound bobbins with a "wild" type of winding. Furthermore, such yarn guiding drums are relatively complicated to produce and are therefore expensive.

However, in the textile industry textile machines producing cross-wound bobbins with spooling devices have also been known for a long time which if necessary also enable the production of cross-wound bobbins which are wound with a "precision" type of winding.

Such textile machines each have in the region of their workstations a device for rotating a textile bobbin and a separate device for traversing an on-running yarn. For example, a drivable bobbin drive drum is used as the rotation device, whilst a mechanism is often used as a yarn traversing device which is equipped with a so-called inverse yarn guide.

In German Patent Publication DE 38 01 980 C2 for example a textile machine producing cross-wound bobbins is described, in which the workstations are each equipped with a yarn traversing device which has an inverse yarn drum, to which the yarn guide of the workstation is connected.

As such inverse yarn drums are mostly lubricated with oil or grease, the inverse yarn drum is surrounded respectively by an inverse yarn housing, which has a slot through which a carrier or a shuttle of the yarn guide projects into the groove of the inverse yarn drum.

To prevent oil or grease escaping out of the yarn guide slot of the inverted yarn housing or prevent textile dust from entering through the slot into the inverted yarn housing, the slot of the inverted yarn housing is generally sealed by a cover connected to the yarn guide, which also denoted as a sealing lip.

A considerable disadvantage of such inverted yarn gears is however that inverted yarn drums are also relatively expensive to produce.

Therefore, in order to reduce the manufacturing costs of such textile machines producing cross-wound bobbins it has already been proposed to simultaneously drive the yarn guides of a plurality of workstations of such a textile machine arranged next to one another by means of a single inverse yarn drum.

In German Patent Publication DE 195 36 761 A1 for example a winding machine is described in which the yarn guide of the yarn traversing devices of a plurality of workstations are operated simultaneously in that a yarn guide driven by an inverted yarn drum is connected by a suitably long sealing lip to the yarn guides of adjacent workstations.

By means of such a construction the manufacturing costs of the yarn traversing devices could be reduced; however as with all inverted yarn gears the aforementioned embodiment has the disadvantage that such inverted yarn gears require a considerable amount of maintenance.

A further disadvantage of such yarn traversing devices with inverted yarn gears is that such inverted yarn gears are relatively loud during operation and that the traversing speeds achievable by means of such devices are relatively low.

Therefore in the past, to increase the traversing speed of textile machines producing cross-wound bobbins, it has already been proposed to connect the yarn guides of the workstations by an endless tensioning means to a reversible, electric motor single drive, which can be driven in a defined manner by an associated control device.

From German Patent Publication DE 37 34 478 A1 for example a yarn traversing device is known in which a yarn guide guided in the region of a workstation on a yarn guide rod is connected by an endless tensioning means to an electric motor single drive, which is designed as a microprocessor-controlled stepping motor.

In this known yarn traversing device both the yarn guide guided on a yarn guide rod and the endless tensioning means are completely free and are thus exposed without protection to the unavoidable textile dust or airborne fiber produced during the winding process.

Similar freely exposed yarn traversing devices with a yarn guide connected by an endless tensioning means to an electric motor single drive are also described in European Patent Publication EP 0 950 631 A1 and/or German Patent Publication DE 103 00 106 A1.

In said known yarn traversing devices the endless tensioning means designed as a drive band or drive belt is guided by a drive wheel connected to a single drive and two guide wheels arranged laterally relative to the traversing area of the workstation.

However, said extremely advantageous yarn traversing devices also have the disadvantage that they are very susceptible to textile dust or airborne fibers which are unavoidable particularly in spooling areas. This means that the aforementioned yarn traversing devices require a considerable amount of continuous cleaning in order to be operated correctly over a longer time period.

The yarn traversing device described in Swiss Patent Publication CH-PS 510 580 also requires such a large amount of cleaning.

In this yarn traversing device in the region of the workstations of a spooling machine two opposite running yarn guides are used. This means that the yarn guides are connected respectively to a drivable endless tensioning means in the form of a toothed belt, wherein one toothed belt rotates clockwise and the other toothed belt rotates anti-clockwise.

The two contrary rotating toothed belts are also each guided with their toothing over a plurality of guide wheels which are designed in the form of lock washers.

Furthermore, from German Patent Publication DE 10 2004 003 173 A1 a yarn traversing device is the prior art for a spooling device of a textile machine producing cross-wound bobbins, in which the endless tensioning means, to which the yarn guide is connected, rotates in a housing of the yarn traversing device which is closed as far as possible. The endless tensioning means designed as a toothed belt is connected to a single drive, that is the toothed belt runs over guide wheels arranged laterally next to the traversing area and over the drive gear of an electric motor single drive.

The yarn traversing device described in German Patent Publication DE 10 2004 003 173 A1 is a clear improvement over the previously known yarn traversing devices, in particular with regard to the cleaning required, however it has the disadvantage that some specific cleaning is necessary on a continual basis.

After a certain operating period of the yarn traversing device problems often occur, for example in the region of the endless tensioning means, particularly in the region of the guide wheels. This means in this known yarn traversing device that, despite the housing which is closed on all sides, fiber residue and dirt particles settle in the region of the toothing of the guide wheels which fiber residue and dirt particles are also additionally compressed by the toothing of the endless tensioning means.

The build-up of fiber residue and dirt particles means that over time the toothed belt is lifted slightly in the region of the guide wheels, which results in negative changes to the predefined traversing width to be covered by the yarn guide.

SUMMARY OF THE INVENTION

On the basis of the aforementioned prior art, the underlying objective of the invention is to develop a yarn traversing device for a spooling device of a textile machine producing cross-wound bobbins, in which it is ensured on the one hand that even after a longer operating period there are no unwanted changes in the traversing width of the yarn guide, and in which it is also ensured that the amount of cleaning required for the correct running of the yarn traversing device can be minimised.

Said objective is achieved according to the invention by a yarn traversing device, in which the toothed belt is guided with its toothing over guide wheels, which have a smooth running surface respectively. For the exact form-fitting drive of the toothed belt it is sufficient if the drive gear connected to the electric motor drive comprises a toothing which corresponds with the toothing of the toothed belt, which is made from a highly elastic, relatively wear-resistant material.

The embodiment according to the invention has the advantage that by means of such a design it is possible to ensure in a relatively simple manner that no residual fibers or the like can settle in the region of the closed housing of the yarn traversing device on the guide wheels, i.e. on the components which are important for correctly maintaining a predefined traversing width of the yarn guide. The design of the guide wheels according to the invention means that any dirt particles that reach the running surface of the guide wheels are removed straight away by the toothing of the relatively rapidly moving endless tensioning means. This means that by avoiding the previously usual toothing of the guide wheels a self-cleaning effect is achieved, and it is ensured that the predefined traversing width of the yarn guide is reliably maintained without additional cleaning being required over a very long operating period.

In an advantageous configuration the smooth running surface of the guide wheels is surrounded respectively by an upper and a lower guiding ring.

By means of such an embodiment it is reliably prevented that during the spinning operation the endless tensioning means runs against parts of the surrounding housing in an unwanted manner, which would have a very negative effect in particular on the service life of the endless tensioning means, and also on the state of the housing of the yarn traversing device. This means that by means of the guiding rings on the guide wheels it is ensured that the endless tensioning means is always guided correctly during the spinning process.

The guide wheels provided with a smooth running surface and an upper and a lower guiding ring are positioned laterally next to the traversing area of the yarn guide a short distance from the front wall sections of the housing of the yarn traversing device, so that the endless tensioning means forms a seal for the yarn traversing device in the region between the guide wheels. This means that by means of the guide wheels designed according to the invention in connection with the endless tensioning means an attempt is not only made to prevent dust particles and airborne fibers penetrating into the housing of the yarn traversing device during the spinning process, but by means of the design according to the invention of the guide wheels it is also ensured that any penetrating airborne fibers cannot settle on the guide wheels.

Furthermore, it is advantageous to use a stepping motor as an electric motor drive which can be driven in a defined manner, which is connected via a control line to a control computer.

Such a stepping motor is an inexpensive mass-produced component which has been tried and tested in textile engineering, which in connection with a control computer ensures the correct operation of the yarn traversing device over a long time period.

In an advantageous embodiment the yarn traversing device is also designed as a modular component in the form of a yarn guiding unit, which if necessary can be replaced completely. This means that the yarn traversing device of the spooling device can if necessary, after loosening a few fastening screws be, removed easily from a workstation of a textile machine producing cross-wound bobbins and a new yarn guiding unit can also be installed again easily.

BRIEF DESCRIPTION OF THE DRAWINGS

The invention is a explained in more detail in the following with reference to an example embodiment illustrated in the drawings, wherein.

DETAILED DESCRIPTION OF THE INVENTION

Figure 1:
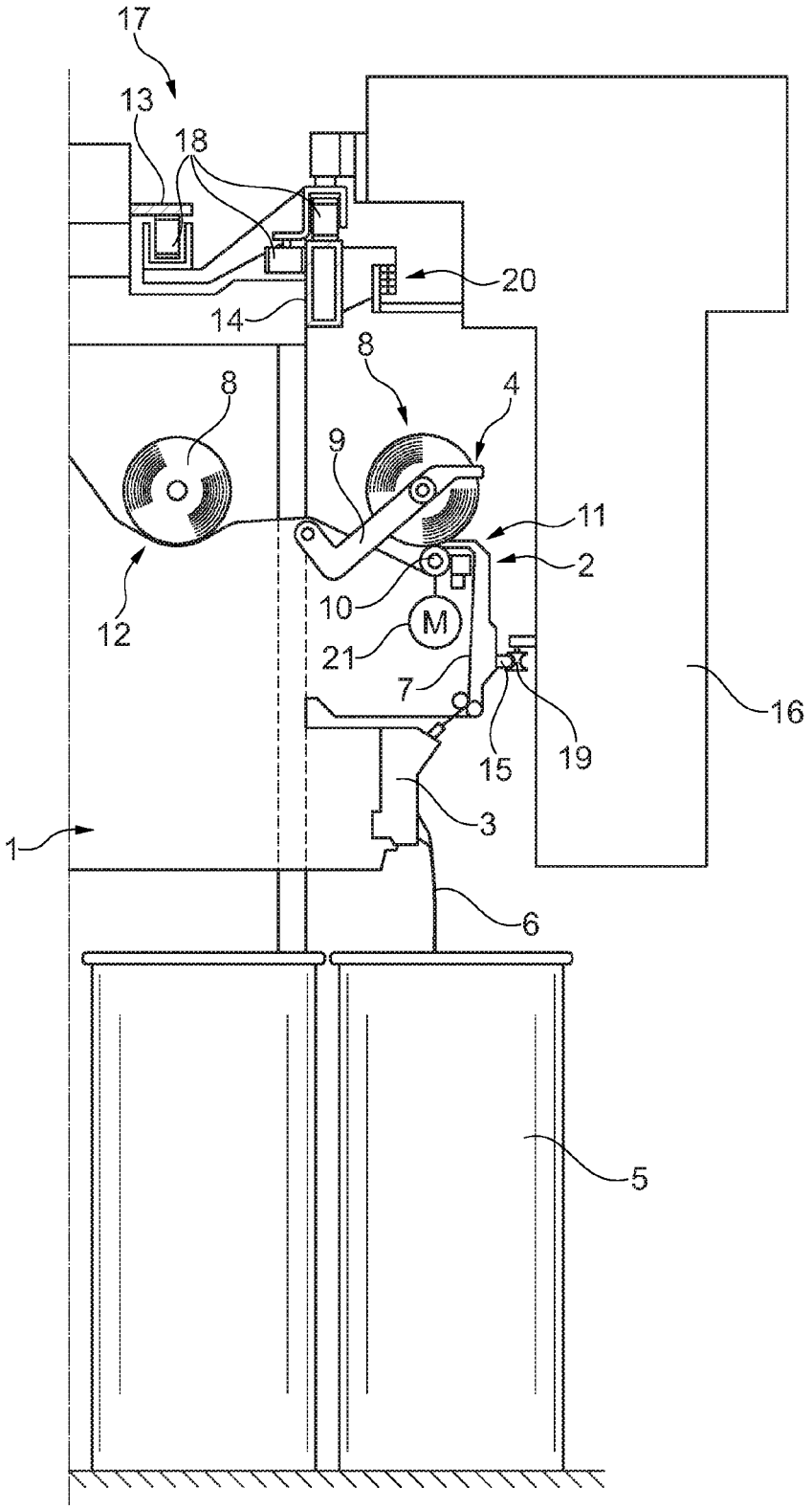
FIG. 1 shows in side view a workstation of a textile machine producing cross-wound bobbins comprising a yarn traversing device according to the invention in the region of the spooling device.

FIG. 1 shows half of a textile machine producing cross-wound bobbins, in the present example embodiment an open-end-rotor spinning machine 1.

This type of already known open-end-rotor spinning machines 1 comprises a plurality of generally identical workstations 2 which are arranged in a row next to one another.

The workstations 2 are equipped respectively with an open-end rotor spinning device 3 and a spooling device 4.

In the open-end rotor spinning device 3, as already known, a sliver 6 stored in a spinning can 5 is spun into a yarn 7, which is then wound on the spooling device 4 into a cross-wound bobbin 8.

As indicated in FIG. 1 the spooling devices 4 each have for this purpose a coil former 9 for rotatably holding the cross-wound bobbins 8, a winding drum 10 for the rotary, frictional drive of the cross-wound bobbins 8 and a yarn traversing device 11.

In the shown example embodiment the winding drum 10 is connected to an electric motor single drive 21.

Such open-end rotor spinning machines 1 are generally also equipped with a cross-wound bobbin transport device 12 for disposing of the cross-wound bobbins 8 produced on the workstations 2.

On the open-end rotor spinning machine 1 there is also often a service unit 16, for example a cross-wound bobbin changer or a yarn-joining car, for example moving on guide rails 13, 14 and a support rail 15, the drive 17 of which comprises rollers 18 or a support wheel 19. The supply of electric power to the service unit 16 is performed for example by a drag chain or, as indicated in the example embodiment, a sliding contact device 20.

Such service units 16 can be driven, as already known, along the workstations 2 of the open-end spinning machine 1 and engage automatically if there is a need for action at one of the workstations 2.

Such a need for action is for example if at one of the workstations a cross-wound bobbin 8 has reached its prescribed diameter and needs to be replaced by a new empty tube, or if a yarn break has occurred at one of the workstations 2 and the workstation 2 has to be repieced.

Figure 2:
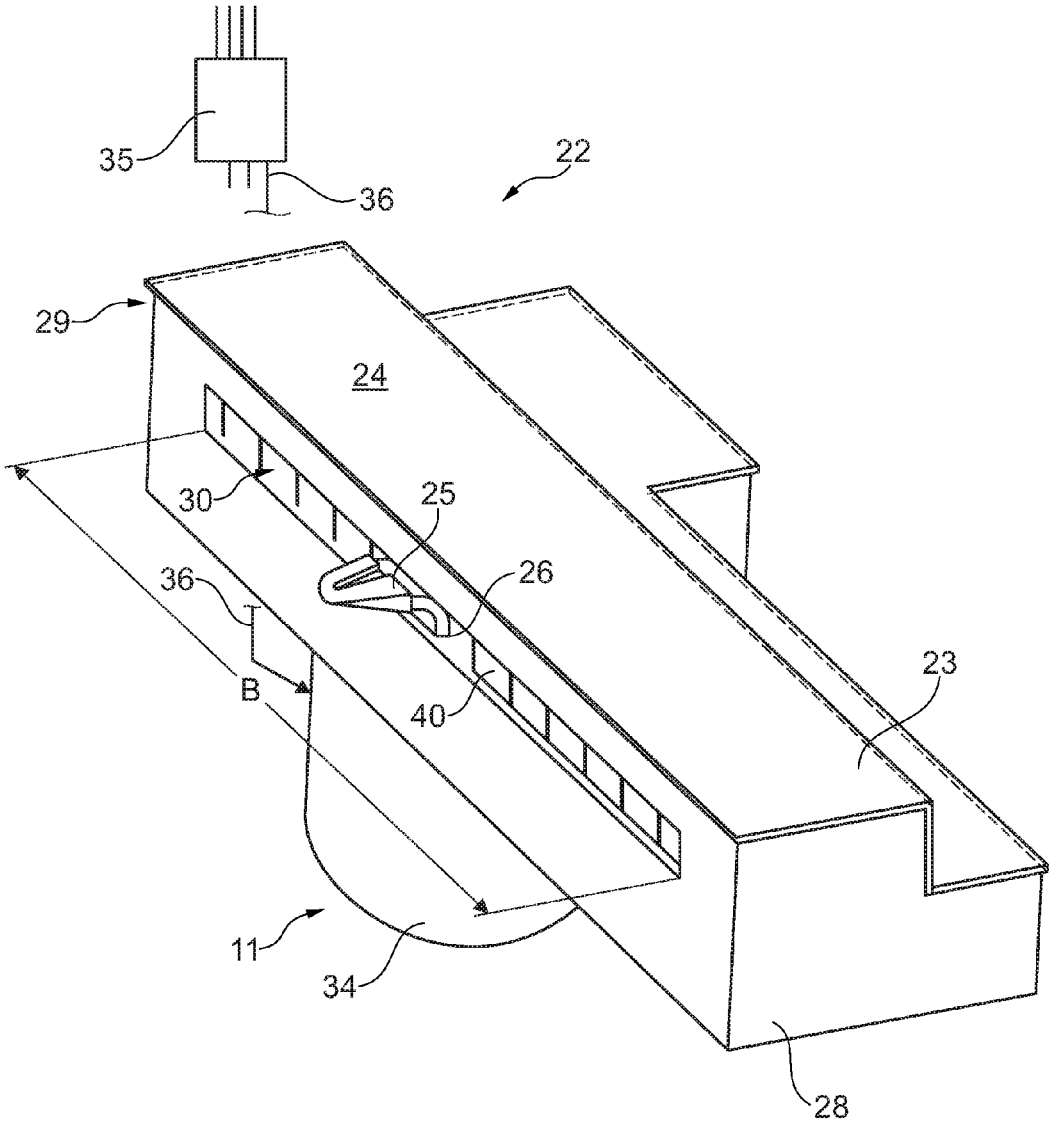
FIG. 2 shows in a perspective front view and on a larger scale a yarn traversing device according to the invention in a closed state.

FIG. 2 shows a perspective front view of one of the yarn traversing devices 11 designed according to the invention and installed in the region of the spooling devices 4 of the workstations 2.

Said yarn traversing devices 11, as shown, are designed respectively as a compact, closed yarn guiding unit 22. This means that the yarn traversing devices 11 each have a closed housing 23, in the inner chamber 37 of which a toothed belt gear 27 for a yarn guide 25 is installed.

The inner chamber 37 of the housing 23 of the yarn traversing device 11, which is delimited by a rear wall and side walls 28, 29 and is covered by a cover element 24, is protected on its front side by an endless tensioning means 30 against the penetration of textile dust and airborne fiber.

As shown, the yarn guide 25, which is made as usual from an abrasion-resistant material, preferably an oxide ceramic, is secured onto a guiding shoe 26, which is secured in turn to the outside 40 of an endless tensioning means, preferably a toothed belt 30.

The toothed belt 30 is connected to an electric motor, reversible drive 34, which is connected by a control line 36 to a control computer 35.

By means of a corresponding drive of the electric motor reversible drive 34, preferably a stepping motor, the control computer 35 ensures that the yarn guide 25 traverses during, the winding operation in a traversing area B, which is adjustable in a defined manner, and thereby ensures that the yarn 7 is wound evenly in crossing layers onto the cross-wound bobbin 8.

Guide wheels 31, 32 of a toothed belt gear 27, designed according to the invention, are arranged at the side next to the traversing area B of the yarn guide 25, as will be explained in the following with reference to FIG. 3.

Figure 3:
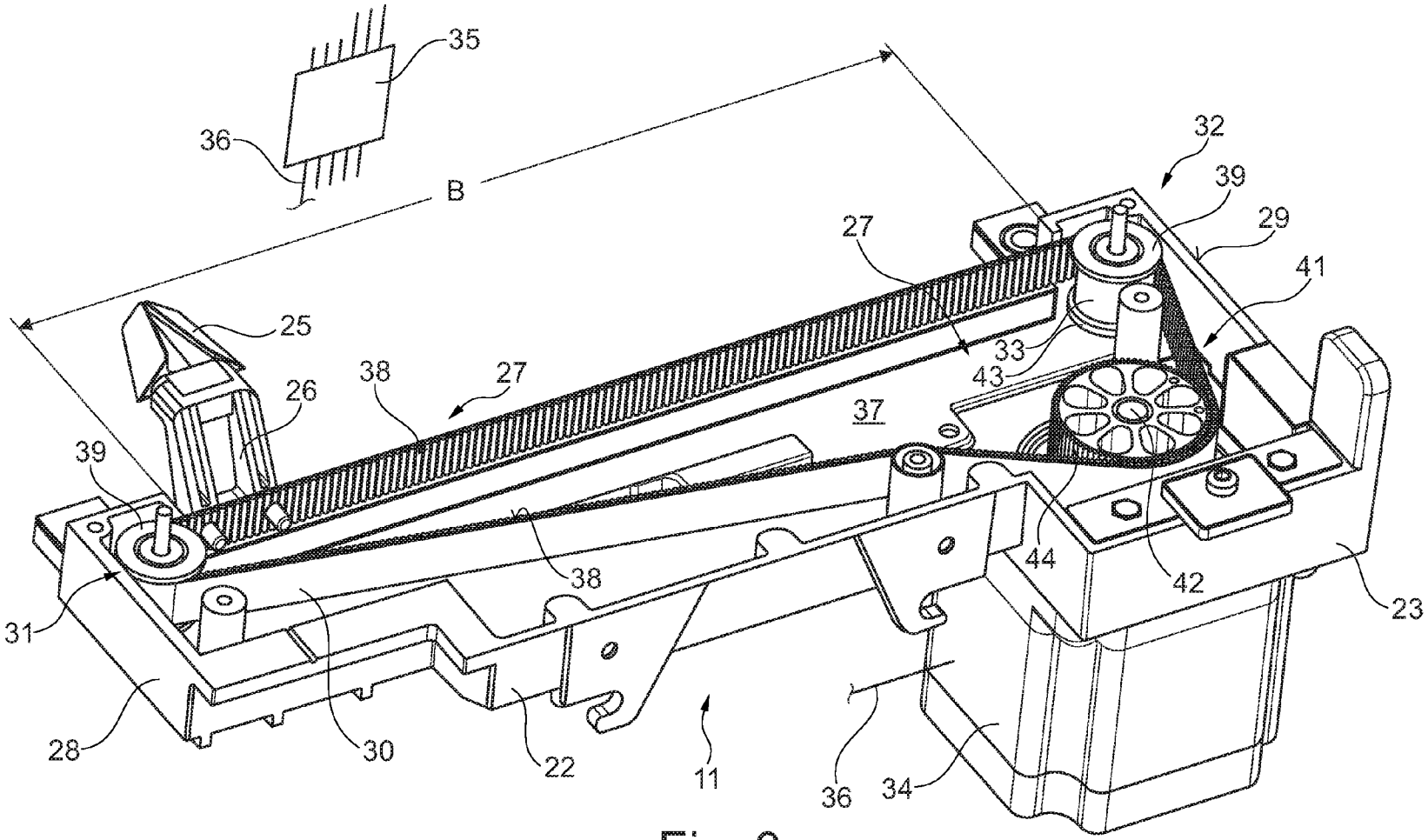
FIG. 3 shows in a perspective rear view the yarn traversing device according to the invention without an upper cover.

FIG. 3 shows the yarn traversing device 11 from FIG. 2 and designed as a compact yarn guiding unit 22 in a perspective rear view and without the cover element 24. This means that FIG. 3 shows a view of the inner chamber 37 of the yarn traversing device 11, in which the toothed belt gear 27 for the yarn guide 25 is arranged.

As shown, the toothed belt 30 is guided in the shown example embodiment by two guide wheels 31, 32 designed according to the invention and a drive wheel 41.

This means that the toothed belt 30 runs over two guide wheels 31, 32 arranged laterally next to the traversing area B of the yarn guide 25, which are each provided with a smooth running surface 33 and an upper 39 and a lower 43 guiding ring and a drive wheel 41 provided with a toothing, which is arranged in a rotationally secure manner on the motor shaft 42 of an electric motor, reversible drive, preferably a stepping motor 34.

The stepping motor 34 is here connected via control line 36 to a control computer 35, for example a central computer of the textile machine, and can be controlled by the latter in a defined manner.

In an alternative embodiment of course also a section computer or a separate workstation computer can be used as a control computer 35.

Figure 4:
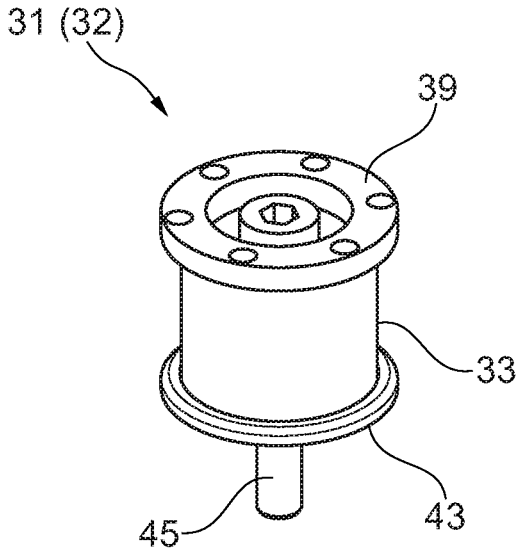
FIG. 4 shows a perspective view of a pulley.

FIG. 4 shows one of the guide wheels 31 or 32 in detail.

A shown, the guide wheel 31 (32) comprises in is middle section a smooth running surface 33, which is largely resistant to dirt or during the spooling process is continually cleaned by the rapid movement of the overlying endless tensioning means 30, in particular by means of its toothing 38. In addition, the running surface can be designed to repel dirt by means of a surface treatment or coating.

Above and below the running surface guiding rings 39 or 43 are arranged, which prevent the endless tensioning means 30 from sliding off the guide wheel 31 (32) and running onto adjacent components of the yarn guiding unit 22.

The guide wheel 31(32) can also be secured via an axis 45 to the housing 23 of the yarn traversing device 11 and has a (not shown) bearing device arranged inside the guide wheel.

The bearing device can be designed for example as a rolling bearing or as a plain bearing device.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Yarn traversing device (11) for a spooling device (4) of a textile machine producing cross-wound bobbins (1) comprising a single yarn guide (25) connected to an endless toothed belt (30) driven reciprocally along a single traversing run by a single reversible electric drive motor (34), wherein the toothed belt (30) rotates in a largely closed housing (23) of the yarn traversing device (11) and is guided by guide wheels (31 or 32) arranged laterally next to a traversing area (B) and a drive wheel (41) connected to the electric motor single drive (34) and wherein the drive wheel (41) connected to the electric motor drive (34) comprises a toothing (44), which corresponds with toothing (38) of the toothed belt (30), the toothed belt (30) being guided with its toothing (38) over the guide wheels (31 or 32), which each have a smooth running surface (33).

2. Yarn traversing device (11) according to claim 1, characterized in that the smooth running surface (33) of the guide wheels (31 or 32) is bordered respectively by an upper (39) and a lower (43) guiding ring.

3. Yarn traversing device (11) according to claim 1, characterized in that the toothed belt (30) is made from a highly elastic, wear-resistant material.

4. Yarn traversing device (11) according to claim 1, characterized in that the electric motor drive (34) is designed as a stepping motor driven in a defined manner and is connected by a control line (36) to a control computer (35).

5. Yarn traversing device (11) according to claim 1, characterized in that the yarn traversing device (11) comprises a compact, modular yarn guiding unit (22), which is completely replaceable if necessary.

* * * * *